US005585323A

United States Patent [19]

Defieuw et al.

[11] Patent Number: 5,585,323

[45] Date of Patent: Dec. 17, 1996

[54] HEAT-RESISTANT LAYER FOR A DYE-DONOR ELEMENT

[75] Inventors: Geert Defieuw, Kessel-Lo; Stefaan De Meutter, Antwerp, both of Belgium

[73] Assignee: Agfa-Gevaert N.V., Mortsel, Belgium

[21] Appl. No.: 527,081

[22] Filed: Sep. 12, 1995

[30] Foreign Application Priority Data

Sep. 27, 1994 [EP] European Pat. Off. ..... 94202768

[51] Int. Cl.[6] ..... B41M 5/035; B41M 5/38

[52] U.S. Cl. ..... 503/227; 428/195; 428/206; 428/328; 428/331; 428/341; 428/412; 428/913; 428/914

[58] Field of Search ..... 8/471; 428/195, 428/206, 328, 331, 341, 412, 913, 914; 503/227

[56] References Cited

FOREIGN PATENT DOCUMENTS

| | | | |
|---|---|---|---|
| 0138483A | 9/1984 | European Pat. Off. | 503/227 |
| 0153880A3 | 3/1985 | European Pat. Off. | 503/227 |

*Primary Examiner*—Bruce H. Hess
*Attorney, Agent, or Firm*—Brumbaugh, Graves, Donohue & Raymond

[57] ABSTRACT

Dye-donor element for use according to thermal dye transfer methods comprising a support having on one side a dye layer and on the side opposite thereto a heat-resistant layer comprising a binder and calcined aluminium silicate particles. The addition of said particles results in less thermal head contamination during printing of high amounts of images especially when printing is done with high printing energies per dot.

11 Claims, No Drawings

HEAT-RESISTANT LAYER FOR A DYE-DONOR ELEMENT

DESCRIPTION

1. Field of the Invention

The present invention relates to dye-donor elements for use according to thermal dye sublimation transfer and in particular to a heat-resistant layer for said dye-donor elements.

2. Background of the Invention

Thermal dye sublimation transfer also called thermal dye diffusion transfer is a recording method in which a dye-donor element provided with a dye layer containing sublimable dyes having heat transferability is brought into contact with a receiver sheet and selectively, in accordance with a pattern information signal, is heated by means of a thermal printing head provided with a plurality of juxtaposed heat-generating elements or resistors, so that dye is transferred from the selectively heated regions of the dye-donor element to the receiver sheet and forms a pattern thereon, the shape and density of which is in accordance with the pattern and intensity of heat applied to the dye-donor element.

A dye-donor element for use according to thermal dye sublimation transfer usually comprises a very thin support e.g. a polyester support, one side of which has been covered with a dye layer comprising the printing dyes. Usually, an adhesive or subbing layer is provided between the support and the dye layer.

Owing to the fact that the thin support softens when heated during the printing operation and then sticks to the thermal printing head, thereby causing malfunction of the printing apparatus and reduction in image quality, the back of the support (the side opposite to that carrying the dye layer) is typically provided with a heat-resistant layer to facilitate passage of the dye-donor element past the thermal printing head. An adhesive layer may be provided between the support and the heat-resistant layer.

The heat-resistant layer generally comprises a lubricant and a binder. In the conventional heat-resistant layers the binder is either a cured binder as described in e.g. EP 153,880, EP 194,106, EP 314,348, EP 329,117, JP 60/151,096, JP 60/229,787, JP 60/229,792, JP 60/229,795, JP 62/48,589, JP 62/212,192, JP 62/259,889, JP 01/5884, JP 01/56,587, and JP 02/128,899 or a polymeric thermoplast as described in e.g. EP 267,469, JP 58/187,396, JP 63/191,678, JP 63/191,679, JP 01/234,292, and JP 02/70,485).

When multiple prints have to be made using high printing energies in the absence of any cleaning procedures of the thermal printing head, a residue resulting from the binder may form on the heat-generating elements of said thermal printing head and, as a consequence, cause malfunction of the printing device and defects such as jamming, scratching of the printed image, and breakdown of the heat-generating elements. This phenomenon occurs in particular when the average printing power of said heat-generating elements exceeds 4.5 W/mm$^2$ and/or when a polymeric thermoplast is used as the binder of the heat resistant layer. The average printing power is calculated as the total amount of energy applied during one line time divided by the line time and by the surface area of the heat-generating elements. Conventional thermal printers usually operate with a maximum average printing power of 3 to 4.5 W/mm$^2$. However, if higher print densities and/or faster printing speeds are wanted, the average printing power has to be higher than 4.5 W/mm$^2$.

These high printing energies are used in thermal sublimation printers, which for the sublimation (or diffusion) of dye require substantially higher printing energies than thermal wax printers, in which delamination and fusion of the dye layer are caused.

It has been suggested in e.g. EP 153,880, EP 194,106, EP 279,467, EP 329,117, EP 407,220, and EP 458,538 to incorporate into the heat-resistant layer particles that have a cleaning effect on the thermal printing head during the printing operation. The particles of the prior art, however, all have one or more disadvantages. Talc and China clay are too soft to remove degraded polymers from the surface of the thermal head, while hard particles such as dolomite, silica and quartz particles abrade the thermal head too much.

In European Patent Application EP 93201642.1, it has been suggested to use a mixture of particles having a Mohs hardness below 2.7 and a second type of particles having a Mohs hardness above 2.7. However, when very high amounts of prints are made, the thermal head still contains contamination on the thermal head and/or shows abrasion at the surface of the passivation layer of the thermal head.

SUMMARY OF THE INVENTION

It is therefore an object of the present invention to provide a dye-donor element for use according to thermal dye transfer methods, said element yielding a reduced contamination of the thermal printing head.

It is also an object of the present invention to provide a heat-resistant layer that minimizes the mechanical wear of the passivation layer of the thermal printing head so that the lifetime of the thermal printing head may be enhanced.

Further objects will become apparent from the description hereinafter.

According to the present invention a dye-donor element for use according to a thermal dye transfer method is provided, said dye donor element comprising a support having on one side a dye layer comprising a dye and a binder and on the side opposite to the side having said dye layer a heat-resistant layer comprising a binder and calcined aluminium silicate particles.

The present invention further provides a method of forming an image using:

(i) a dye donor element comprising a support having on one side a dye layer comprising a dye and a binder and on the side opposite to the side having said dye layer a heat resistant layer comprising a binder and calcined aluminium silicate particles and (ii) an image receiving element comprising on a support an image receiving layer, said method comprising the steps of:

bringing said dye layer of said dye donor element into face-to-face relationship with said image receiving layer of said image receiving element:

image-wise heating a thus obtained assemblage thereby causing transfer of said dye to said receiving layer and separating said dye donor element from said image receiving element.

DETAILED DESCRIPTION OF THE INVENTION

The heat-resistant layer of the present invention comprises a binder and calcined aluminium silicate particles. Aluminium silicates or China clays are hydrous upon recovery and can be calcined upon heat treatment at temperatures above 500° C. The hydroxyl groups, which form part of the crystal structure are lost as steam.

The average particle size after calcination is preferably less than 2 μm, more preferably between 0.3 and 1.5 μm.

Examples of calcinated particles are calcined aluminium silicate 1 :

Satintone Special™: calcined with an average particle size of 1–2μ (Engelhard minerals)

calcined aluminium silicate 2 :

Satintone™ #5 : calcined aluminium silicate with an average particle size of 0.8μ (Engelhard minerals)

calcined aluminium silicate 3 :

Polestar™ 400A: calcined aluminium silicate with an average particle size of 0.8μ (ECC)

calcined aluminium silicate 4:

Polestar™ 200R: calcined aluminium silicate with an average particle size of 0.8μ (ECC).

The calcined aluminium silicate particles can further be surface modified such as in Translink™ 37, Translink™ 77, Translink™ 445, Translink™ 555, and Translink™ HF-900 (all available from Engelhard minerals).

Other particles can be used in combination with the particles of the present invention. These particles may be meltable or non-meltable.

Non-meltable particles suitable for use in combination with the above calcined aluminium silicate particles are talc particles, China clay particles, dolomite particles, silica particles and the like.

Meltable particles can be wax particles such as polyolefin particles such as polyethylene, polypropylene, amid wax particles such as stearamide and ethylenebisstearamide, ester wax particles such as carnauba wax, bees wax and glycerine monostearate, metal soap particles of fatty acids such as lithium stearate, magnesium stearate, zinc stearate and the like.

Particular useful particle mixtures are mixtures of talc, calcined aluminium silicate and a salt of a fatty acid and particle mixtures of calcined aluminium silicate and a salt of a fatty acid. In the above mentioned mixtures, the salt of the fatty acid is preferably zinc stearate.

The total amount of particles in the heat-resistant layer is generally not higher than 1 g/m$^2$ and smaller amounts usually suffice to clean the thermal printing head during the printing operation.

Preferably 2 to 500 mg/m$^2$ aluminium silicate particles are used in the heat-resistant layer, more preferably 5 to 200 mg/m$^2$.

In case particles having a Mohs hardness of more than 2.7 are used, the amount thereof is preferably less than the amount of calcined aluminium silicate particles, more preferably the weight ratio of particles having a Mohs hardness of more than 2.7 to the calcined aluminium silicate particles is not more than 1:2.

Colloidal silica such as Aerosil™ R972 (Degussa) can further be added to the heat-resistant layer according to the present invention.

The binder for the heat-resistant layer can be a cured binder or a polymeric thermoplast.

A cured binder can be produced by a chemical reaction as described in e.g. EP 1530880 and EP 194,106, or by the influence of moisture as described in e.g. EP 528 074, or by irradiation of a radiation-curable composition as described in e.g. EP 314,348 and EP 458,538.

Thanks to the fact that the coating procedure of polymeric thermoplasts is very convenient, they are preferably used as binder for the heat-resistant layer. Preferred polymeric thermoplasts are those having a glass transition temperature above 100° C.; these thermoplasts are suited for use as binder in the heat-resistant layer, because they are dimensionally stable at higher temperatures. Polymers having a glass transition temperature above 170° C. are especially preferred. Even more preferred polymeric thermoplasts are those that are soluble in ecologically acceptable solvents such as ketones (e.g. ethyl methyl ketone and acetone) and alcohols (e.g. isopropanol).

Representatives of polymeric thermoplasts that are suited for use as binder in the heat-resistant layer are e.g. poly-(styrene-coacrylonitrile), polycarbonates derived from bisphenol A, polyvinyl butyral, polyvinyl acetal, ethyl cellulose, cellulose acetate butyrate, cellulose acetate propionate, and polyparabanic acid.

Especially preferred polymeric thermoplasts are the polycarbonates derived from a bis-(hydroxyphenyl)-cycloalkane corresponding to general formula (I):

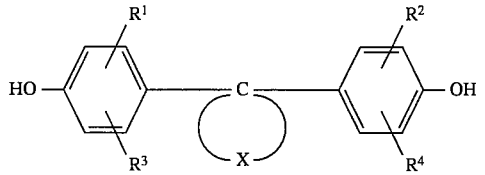

(I)

wherein:

$R^1$, $R^2$ , $R^3$, and $R^4$ independently represent hydrogen, halogen, a $C_1$–$C_8$ alkyl group, a substituted $C_1$–$C_8$ alkyl group, a $C_5$–$C_6$ cycloalkyl group, a substituted $C_5$–$C_6$ cycloalkyl group, a $C_6$–$C_{10}$ aryl group, a substituted $C_6$–$C_{10}$ aryl group, a $C_7$–$C_{12}$ aralkyl group, or a substituted $C_7$–$C_{12}$ aralkyl group; and X represents the atoms necessary to complete a 5- to 8-membered alicyclic ring, which optionally carries at least one $C_1$–$C_6$ alkyl group or at least one 5- or 6-membered cycloalkyl group, or carries a fused-on 5- or 6-membered cycloalkyl group.

These polycarbonates provide a better heat-stability to the heat-resistant layer than conventional polymeric thermoplasts. They also have higher glass transition temperatures (Tg), typically in the range of about 180° C. to about 260° C., than polycarbonates derived from bisphenol A (Tg of about 150° C.). The polycarbonates can be homopolycarbonates as well as copolycarbonates.

Preferably one to two carbon atoms of the group of atoms represented by X, more preferably only one carbon atom of that group, carry (carries) two $C_1$–$C_6$ alkyl groups on the same carbon atom. A preferred alkyl group is methyl. Preferably, the carbon atoms of the group of atoms represented by X, which stand in α-position to the diphenyl-substituted carbon atom, do not carry two $C_1$–$C_6$ alkyl groups. Substitution with two $C_1$–$C_6$ alkyl groups is preferred on the carbon atom(s) in β-position to the diphenyl-substituted carbon atom is preferred.

Preferred examples of bis-(hydroxyphenyl)-cycloalkanes corresponding to general formula I, which can be employed for preparing the polycarbonates that can be used according to the present invention are those comprising 5- or 6-membered alicyclic rings. Examples of such bis-(hydroxyphenyl)-cycloalkanes are e.g. bis(4-hydroxyphenyl)-3,3,5-trimethylcyclohexane, bis(4-hydroxyphenyl)-3,3-dimethylcyclohexane and bis(4-hydroxyphenyl)-3,3,6-trimethylcyclohexane.

A particularly preferred bis-(hydroxyphenyl)-cycloalkane is 1,1-bis-(4-hydroxyphenyl)-3,3,5-trimethylcyclohexane).

The synthesis of suitable bis-(hydroxyphenyl)-cycloalkanes corresponding to general formula (I) has been described in e.g. DE 3 832 396. The bis-(hydroxyphenyl)-cycloalkanes are used to prepare high molecular weight thermoplastic aromatic polycarbonates for use according to the present invention.

Homopolycarbonates can be prepared from bis-(hydroxyphenyl)-cycloalkanes corresponding to general formula (I), but also copolycarbonates can be prepared by simultaneously using different bis-(hydroxyphenyl)-cycloalkanes, each of which individually corresponds to the general formula (I).

In the preparation of high molecular weight, thermoplastic, aromatic polycarbonates the bis-(hydroxyphenyl)-cycloalkanes corresponding to general formula (I) can also be used in combination with other hydroxyphenyl compounds that do not correspond to general formula (I), e.g. with compounds that correspond to the general formula:

$$HO—Z—OH \quad (II)$$

Useful compounds corresponding to general formula (II) are diphenols, in which Z represents a bivalent aromatic ring system having from 6 to 30 carbon atoms, which ring system contains at least one aromatic nucleus. The aromatic group Z may carry substituents and may contain aliphatic or alicyclic residues such as the alicyclic residues contained in the bis-(hydroxyphenyl)-cycloalkanes corresponding to general formula (I) or may contain heteroatoms e.g. —O—, as a link between the separate aromatic nuclei.

Examples of compounds corresponding to general formula (II) are i.a. hydroquinone, resorcinol, dihydroxydiphenyl, bis-(hydroxy-phenyl)-alkanes, bis-(hydroxyphenyl)-cycloalkanes, bis-(hydroxy-phenyl)-sulfide, bis-(hydroxyphenyl)-ether, bis-(hydroxyphenyl)ketone, bis-(hydroxyphenyl)-sulfone, bis-(hydroxyphenyl)-sulfoxide, α,α'-bis-(hydroxyphenyl)-diisopropylbenzene, and such compounds carrying at least one alkyl and/or halogen substituent on the aromatic nucleus.

These and other suitable compounds corresponding to general formula (II) have been described in e.g. U.S. Pat. Nos. 3,028,365, 2,999,835, 3,148,172, 3,275,601, 2,991,273, 3,271,367, 3,062,781, 2,970,131, 2,999,846, DE 1,570,703, DE 2,063,050, DE 2,063,052, DE 2,211,956, FR 1,561,518, and in "Chemistry and Physics of Polycarbonates", Interscience Publishers, New York, 1964.

Other preferred compounds corresponding to general formula (II) are i.a. 4,4'-dihydroxydiphenyl, 2,2-bis-(4-hydroxyphenyl)-propane, 2,4-bis-(4-hydroxyphenyl)-2-methylbutane, 1,1-bis-(4-hydroxyphenyl)-cyclohexane, α,α'-bis-(4-hydroxyphenyl)-p-diisopropyl-benzene, 2,2-bis-(3-methyl-4-hydroxyphenyl)-propane, 2,2-bis-(3-chloro-4-hydroxyphenyl)-propane, bis-(B,5-dimethyl-4-hydroxyphenyl)-methane, 2,2-bis-(3,5-dimethyl-4-hydroxyphenyl)-propane, bis-(3,5-dimethyl-4-hydroxyphenyl)-sulfone, 2,4-bis-(3,5-dimethyl-4-hydroxyphenyl)-2methylbutane, 1,1-bis-(3,5-dimethyl-4-hydroxyphenyl)-cyclohexane, α,α'-bis-(3,5-dimethyl-4-hydroxyphenyl)-p-diisopropylbenzene, 2,2-bis-(3,5-dichloro-4-hydroxyphenyl)-propane, and 2,2-bis-(3,5-dibromo-4-hydroxyphenyl)-propane.

Especially preferred compounds corresponding to general formula (II) are i.a. 2,2-bis-(4-hydroxyphenyl)-propane, 2,2-bis-(3,5-dimethyl-4-hydroxyphenyl)-propane, 2,2-bis-(3,5-dichloro-4-hydroxy-phenyl)-propane, 2,2-bis-(3,5-dibromo-4-hydroxyphenyl)-propane, and 1,1-bis-(4-hydroxyphenyl)-cyclohexane.

Especially preferred is 2,2-bis-(4-hydroxyphenyl)-propane (bisphenol A).

Incorporation of bisphenol A in the polycarbonate reduces the brittleness of the polycarbonate. This results in less scratches caused by the contaminated thermal printing head in the transferred image. However, by incorporation of bisphenol A the glass transition temperature is decreased as compared with that of the homopolycarbonate. A compromise has thus to be found between scratching and heat-stability.

If in the preparation of polycarbonates mentioned above the bis-(hydroxyphenyl)-cycloalkanes corresponding to general formula (I) are used together with at least one compound corresponding to general formula (II), the amount of bis-(hydroxyphenyl)-cycloalkanes corresponding to general formula (I) in the mixture is preferably at least 10 mol %, preferably at least 25 mol %.

The binder of the heat-resistant layer of the dye-donor element according to the present invention may also consist of at least two different mixed binders.

The heat-resistant layer of the dye-donor element according to the present invention may in addition to said particles and the binder comprise minor amounts of such other agents like surface-active agents and liquid lubricants.

The heat-resistant layer according to the present invention may contain other additives provided such materials do not inhibit the anti-sticking properties of the heat-resistant layer and provided that such materials do not substantially scratch, erode, contaminate, or otherwise damage the thermal printing head or harm image quality. Examples of suitable additives have been described in EP 389,153.

Suitable surface-active agents for the heat-resistant layer of the dye-donor element according to the present invention are i.a.: alkyl phenyl polyalkylene oxides e.g. Antarox™ CO 630 (GAF), alkyl polyalkylene oxides e.g. Renex™ 709 (ICI), and sorbitol esters e.g. Span™ 85 (ICI) and Tween™ 20 (ICI).

Preferred lubricants for use in the heat-resistant layer of the dye-donor element according to the present invention are polysiloxan-based lubricants. Among these polyalkylene oxide-modified polydimethylsiloxans such as Byk™ 320, Byk™ 307, and Byk™ 330 (Byk Cera) and Tegoglide™ 410 (Goldschmidt) are especially preferred.

The heat-resistant layer of the dye-donor element according to the present invention is formed preferably by adding the polymeric thermoplastic binder or binder mixture, the calcined aluminium silicate particles, and other optional components to a suitable solvent or solvent mixture, dissolving or dispersing the ingredients to form a coating composition, applying said coating composition to a support, which may have been provided first with an adhesive or subbing layer, and drying the resulting layer. It can be advantageous to use a ball mill to reduce the particle size of the particles in the coating solution.

The heat-resistant layer of the dye-donor element may be coated on the support or printed thereon by a printing technique such as a gravure process.

The heat-resistant layer thus formed has a thickness of about 0.1 to 3 μm, preferably 0.3 to 1.5 μm.

Although the above-mentioned ingredients of the heat-resistant layer can be incorporated in one single layer, it is sometimes preferred to incorporate at least part of the additives such as lubricants and/or surface-active agents in a separate topcoat on top of the heat-resistant layer. As a result the lubricants and/or surface-active agents are in direct contact with the thermal printing head and thus lead to improved slipping properties of the the dye-donor element.

It is highly preferred to add a polysiloxane based lubricant and/or a metal salt of a fatty acid to said heat-resistant layer and/or top coat layer of the present invention. It is even more preferred to add a polymethylsiloxane based lubricant and zinc stearate to said heat-resistant layer and/or top coat layer of the present invention.

Preferably a subbing layer is provided between the support and the heat-resistant layer to promote the adhesion between the support and the heat-resistant layer. As subbing layer any of the subbing layers known in the art for dye-donor elements can be used. Suitable binders that can be used for the subbing layer can be chosen from the classes of polyester resins, polyurethane resins, polyester urethane resins, modified dextrans, modified cellulose, and copolymers comprising recurring units such as i.a. vinyl chloride, vinylidene chloride, vinyl acetate, acrylonitrile, methacrylate, acrylate, butadiene, and styrene (e.g. poly(vinylidene chloride-co-acrylonitrile). Suitable subbing layers have been described in e.g. EP 138,483, EP 227,090, EP 546 010, U.S. Pat. Nos. 4,567,113, 4,572,860, 4,717,711, 4,559,273, 4,695,288, 4,727,057, 4,737,486, 4,965,239, 4,753,921, 4,895,830, 4,929,592, 4,748,150, 4,965,238, and 4,965,241. The subbing layer may further comprise an aromatic polyol such as e.g. 1,2-dihydroxybenzene as described in EP 433, 496.

The calcined aluminium silicate particles for use in accordance with the present invention can be incorporated at least partially into a said subbing layer between the support and said heat-resistant layer.

Any dye can be used in the dye layer of the dye-donor element of the present invention provided it is transferable to the receiver sheet by the action of heat. Examples of suitable dyes have been described in e.g. EP 432,829, EP 400,706 and in the references mentioned therein.

The amount ratio of dye or dye mixture to binder generally ranges from 9:1 and 1:3 by weight, preferably from 3:1 and 1:2 by weight.

The following polymers can be used as polymeric binder: cellulose derivatives, such as ethyl cellulose, hydroxyethyl cellulose, ethylhydroxy cellulose, ethylhydroxyethyl cellulose, hydroxypropyl cellulose, methyl cellulose, cellulose nitrate, cellulose acetate formate, cellulose acetate hydrogen phthalate, cellulose acetate, cellulose acetate propionate, cellulose acetate butyrate, cellulose acetate pentanoate, cellulose acetate benzoate, cellulose triacetate: vinyl-type resins and derivatives, such as polyvinyl alcohol, polyvinyl acetate, polyvinyl butyral, copolyvinyl butyral-vinyl acetal-vinyl alcohol, polyvinyl pyrrolidone, polyvinyl acetoacetal, polyacrylamide: polymers and copolymers derived from acrylates and acrylate derivatives, such as polyacrylic acid, polymethyl methacrylate and styrene-acrylate copolymers; polyester resins: polycarbonates such as the polycarbonates described above for the heat resistant layer; copoly(styrene/acrylonitrile); polysulfones; polyphenylene oxide: organosilicones, such as polysiloxans; epoxy resins and natural resins, such as gum arabic. Preferably, the binder for the dye layer of the present invention comprises copoly(styrene/acrylonitrile).

The dye layer may also contain other additives such as i.a. thermal solvents, stabilizers, curing agents, preservatives, organic or inorganic fine particles, dispersing agents, antistatic agents, defoaming agents, and viscosity-controlling agents, these and other ingredients being described more fully in EP 133,011, EP 133,012, EP 111,004, and EP 279,467.

Dendrimers, also called highly branched non-crosslinked polymers can be added as a density improving agent or thermal solvent to the dye layer of the dye donor element in order to improve the dye transfer efficiency during printing.

Highly branched, non-crosslinked polymers have been prepared by "multiple generation" and "single generation" procedures. Dendrimeric latices suitable for use in the present invention, can be prepared by a multiple generation procedure. Such procedures have been described e.g. by Tomalia, D. A. and others in Angewandte Chemie, Int. Ed. in English, 29, 138–175 (1990), in EP-A 66366 and in WO 84/2705 etc.. In these disclosures, highly branched non-crosslinked polymers or oligomers are described, in particular polyamido amines and polybenzyl ethers.

Further methods for preparing dendrimers are disclosed in EP-A 582842, EP-A 583608, EP-A 583609 and WO 93/017060. Dendrimers are also commercially available from DSM (Netherlands) and DENDRITECH (USA).

Addition of beads of polyolefin waxes or amid waxes, and/or of polymethylsilylsesquioxan particles, as described in EP 554 583, to the dye layer, said beads and/or particles protruding from the surface of said layer, is especially preferred.

Any material can be used as the support for the dye-donor element provided it is dimensionally stable and capable of withstanding the temperatures involved, up to 400° C. over a period of up to 20 msec, and is yet thin enough to transmit heat applied on one side through to the dye on the other side to effect transfer to the receiver sheet within such short periods, typically from 1 to 10 msec. Such materials include polyesters such as polyethylene terephthalate, polyamides, polyacrylates. polycarbonates, cellulose esters, fluorinated polymers, polyethers, polyacetals, polyolefins, polyimides, glassine paper and condenser paper. Preference is given to a support comprising polyethylene terephthalate. In general, the support has a thickness of 2 to 30 μm. The support may also be coated with an adhesive of subbing layer, if desired. Examples of suitable subbing layers have been described in e.g. EP 433,496, EP 311,841, EP 268,179, U.S. Pat. Nos. 4,727,057, and 4,695,288.

A dye-barrier layer comprising a hydrophilic polymer may also be employed between the support and the dye layer of the dye-donor element to enhance the dye transfer densities by preventing wrong-way transfer of dye backwards to the support. The dye barrier layer may contain any hydrophilic material that is useful for the intended purpose. In general, good results have been obtained with gelatin, polyacrylamide, polyisopropylacrylamide, butyl methacrylate-grafted gelatin, ethyl methacrylate-grafted gelatin, ethyl acrylate-grafted gelatin, cellulose monoacetate, methyl cellulose, polyvinyl alcohol, polyethyleneimine, polyacrylic acid, a mixture of polyvinyl alcohol and polyvinyl acetate, a mixture of polyvinyl alcohol and polyacrylic acid or a mixture of cellulose monoacetate and polyacrylic acid, Suitable dye barrier layers have been described in e.g. EP 227,091 and EP 228,065. Certain hydrophilic polymers e.g. those described in EP 227,091 also have an adequate adhesion to the support and the dye layer so that the need for a separate adhesive or subbing layer is avoided. These particular hydrophilic polymers used in a single layer in the dye-donor element thus perform a dual function, hence are referred to as dye-barrier/subbing layers.

The support for the image receiving element that is used with the dye-donor element may be a transparent film of e.g. polyethylene terephthalate, a polyether sulfone, a polyimide, a cellulose ester, or a polyvinyl alcohol-co-acetal. The support may also be a reflective one such as a baryta-coated paper, polyethylene-coated paper or white polyester i.e. white-pigmented polyester. Blue-coloured polyethylene terephthalate film can also be used as support.

To avoid poor adsorption of the transferred dye to the support of the image receiving element this support must be coated with a special layer called dye-image-receiving layer, into which the dye can diffuse more readily. The dye-image-receiving layer may comprise e.g. a polycarbonate, a polyurethane, a polyester, a polyamide, polyvinyl chloride, polystyrene-co-arcylonitrile, polycaprolactone, or mixtures thereof. The dye-image receiving layer may also comprise a heat-cured product of poly(vinyl chloride/co-vinyl acetate/co-vinyl alcohol) and polyisocyanate. Suitable dye-image-receiving layers have been described in e.g. EP 133,011, EP 133,012, EP 144,247, 227,094, and EP 228,066.

Dendrimers can be added as a plasticizer to the receiving layer in order to increase the density of the printed image, Moreover, it can act as a coreactant in the cross-linking process when a cured image-receiving layer is used. In this case, functional groups such as e.g. carboxyl groups, hydroxyl groups or amino groups are required.

In order to improve the light resistance and other stabilities of recorded images, UV absorbers, singlet oxygen quenchers such as HALS-compounds (Hindered Amine Light Stabilizers) and/or antioxidants may be incorporated into the dye-image-receiving layer.

The dye layer of the dye-donor element or the dye-image-receiving layer of the image receiving element may also contain a releasing agent that aids in separating the dye-donor element from the receiving element after transfer. The releasing agents can also be applied in a separate layer on at least part of the dye layer or of the dye-image-receiving layer. Suitable releasing agents are solid waxes, fluorine- or phosphate-containing surfactants and silicone oils. Suitable releasing agents have been described in e.g. EP 133,012, JP 85/19,138, and EP 227,092.

The dye-donor elements according to the invention are used to form a dye transfer image, which process comprises placing the dye layer of the dye-donor element in face-to-face relation with the dye-image-receiving layer of the image receiving element and image-wise heating from preferably the back of the dye-donor element. The transfer of the dye is accomplished by heating for about several milliseconds at a temperature of 400° C.

Preferably, the average printing power applied by means of a thermal printing head during the image-wise heating of the dye-donor element is higher than 4.5 W/mm$^2$.

When the image-wise heating process is performed for but one single colour, a monochromic dye transfer image is obtained. A multicolour image can be obtained by using a dye-donor element containing three or more primary colour dyes and sequentially performing the process steps described above for each colour. The above sandwich of dye-donor element and image receiving element is formed on three occasions during the time when heat is applied by the thermal printing head. After the first dye has been transferred, the elements are peeled apart. A second dye-donor element (or another area of the dye-donor element with a different dye area) is then brought in register with the dye-receiving element and the process is repeated. The third colour and optionally further colours are obtained in the same manner.

The heat-resistant layer in accordance with the present invention can also be used as a back coat layer for the reductor donor element such as mentioned e.g. in European Patent Applications no. 94200795.6 and no. 94200796.4.

The following example illustrates the invention in more detail without, however, limiting the scope thereof.

EXAMPLE

A series of dye-donor elements for use according to thermal dye sublimation transfer were prepared as follows.

Polyethylene terephthalate film having a thickness of 6 μm was provided on both sides with a subbing layer from a solution of copolyester comprising isophthalic acid units/terephthalic acid units/ethylene glycol units/neopentyl glycol units/adipic acid units/glycerol units in ethyl methyl ketone.

A solution comprising 6% by weight of dye A, 6 % by weight of dye B, and 10 % by weight of poly(styrene-co-acrylonitrile) as binder in ethyl methyl ketone as solvent was prepared: C.I. Disperse Yellow 201 Dye A

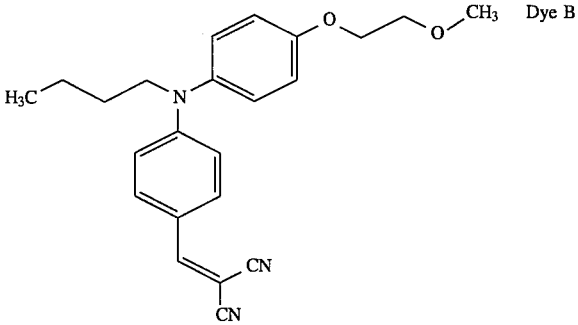

From the resulting solution a layer having a wet thickness of 9 μm was coated on the subbed polyethylene terephthalate film. The resulting dye layer was dried by evaporation of the solvent.

A heat-resistant layer having a wet thickness of 4.8 μm was coated on the subbed back of the polyethylene terephthalate film from a solution in ethyl methyl ketone containing a polycarbonate binder PC1 (13% by weight), 0.5% zinc stearate particles having an average particle size of 3.5 μm, 1% Tegoglide 410 (Goldsmidt), and particles (the nature and amount of which are indicated in Table 1).

PC1: A polycarbonate derived from 1,1-bis-(4-hydroxyphenyl)-3,3,5-trimethylcyclohexane having a molecular weight such that a relative viscosity of 1.295 (measured in a 0.5% by weight solution in dichloromethane) is obtained.

Receiver sheets were prepared by coating a polyethylene terephthalate film support having a thickness of 175 μm with a dye-image-receiving layer from a solution in ethyl methyl ketone of 3.6 g/m$^2$ of poly(vinyl chloride/co-vinyl acetate/co-vinyl alcohol) (Vinylire VAGD supplied by Union Carbide), 0.200 g/m$^2$ of diisocyanate (Desmodur N75 supplied by Bayer AG), and 0.2 g/m$^2$ of hydroxy-modified polydimethylsiloxan (Tegomer H SI 2111 supplied by Goldschmidt).

Each dye-donor element was printed in combination with a receiver sheet in a printer set-up using a Kyocera thermal printing head. Type KGT-219-12MP4-75PM at an average power of 60 mW per dot (total amount of energy applied to one resistor element divided by the total line time, 80 mW with a duty cycle of 75%). The surface of the heater element measured 68 by 152 mm. Consequently, the average printing power applied to the heater elements was 5.8 W/mm$^2$. The printing was repeated 100 times for each dye-donor element. The length of the image was approximately 20 cm. All heat-resistant layers as identified in Table 1 hereinafter allowed easy continuous transport across the thermal printing head.

Next, the thermal printing head was disconnected from the printer and inspected under an optical microscope (Leitz microscope: enlargement 100x) to trace any contamination of the resistors of the thermal printing head. The following levels of contamination were attributable: good (no contamination at all), and bad (visual contamination in the centre of the electrodes).

In Table 1 hereinafter (G) stands for good, and (B) for bad. The amounts of the inorganic particles and binder are indicated in % by weight calculated on the total weight of the coating solution (solvent was added up to 100%). The results obtained are listed in Table 1.

TABLE 1

| Example | Heat-resistant layer composition Type of particles | Amount | Contamination |
|---|---|---|---|
| Comparative 1 | Talc | 0.5 | B |
| Comparative 2 | Hydrous aluminium silicate | 0.5 | B |
| Comparative 3 | Hydrous aluminium silicate (*) | 0.5 | B |
| Invention 1 | Calcined aluminium silicate 1 | 0.5 | G |
| Invention 2 | Calcined aluminium silicate 2 | 0.5 | G |
| Invention 3 | Calcined aluminium silicate 3 | 0.5 | G |

Talc: Microace Talc P3 ™ (Interorgana)
Hydrous aluminium silicate: China clay grade A (Goomvean and Rostowrack China Clay Company)
(*) The hydrous aluminium silicate has been dispersed in a ball mill in order to reduce the amount of particles above 10 μm.

It can be seen from table 1 that calcined aluminium silicate particles perform better than the particles of the prior art. Moreover, the image quality of the printed images is excellent and no wear was observed at the surface of the passivation layer of the thermal head.

We claim:

1. A dye-donor element for use according to a thermal dye transfer method, said dye donor element comprising a support having on one side a dye layer comprising a dye and a binder and on the side opposite to the side having said dye layer a heat-resistant layer comprising a binder and calcined aluminium silicate particles.

2. Dye-donor element according to claim 1, wherein said calcined aluminium silicate particles have an average particle size of 0.3 to 2 μm.

3. Dye-donor element according to claim 1 wherein said heat-resistant layer comprises 2 to 500 mg/m2 of aluminium silicate particles.

4. Dye donor element according to claim 1 wherein said binder for said heat-resistant layer is a polymeric thermoplast.

5. A dye-donor element according to claim 4, wherein said polymeric thermoplast is a polycarbonate derived from a bis-(hydroxyphenyl)-cycloalkane corresponding to general formula (I):

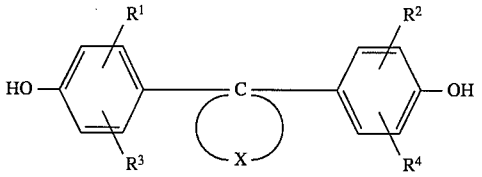

wherein:

$R^1$, $R^2$, $R^3$, and $R^4$ independently represent hydrogen, halogen, a $C_1$–$C_8$ alkyl group, a substituted $C_1$–$C_8$ alkyl group, a $C_5$–$C_6$ cycloalkyl group, a substituted $C_5$–$C_6$ cycloalkyl group, a $C_6$–$C_{10}$ aryl group, a substituted $C_6$–$C_{10}$ aryl group, a $C_7$–$C_{12}$ aralkyl group, or a substituted $C_7$–$C_{12}$ aralkyl group; and X represents the atoms necessary to complete a 5- to 8-membered alicyclic ring, which optionally carries at least one $C_1$–$C_6$ alkyl group or at least one 5- or 6-membered cycloalkyl group, or carries a fused-on 5- or 6-membered cycloalkyl group.

6. A method of forming an image using (i) a dye donor element comprising a support having on one side a dye layer comprising a dye and a binder and on the side opposite to the side having said dye layer a heat resistant layer comprising a binder and calcined aluminium silicate particles and (ii) an image receiving element comprising on a support an image receiving layer, said method comprising the steps of:

bringing said dye layer of said dye donor element into face-to-face relationship with said image receiving layer of said image receiving element:

image-wise heating a thus obtained assemblage thereby causing transfer of said dye to said receiving layer and separating said dye donor element from said image receiving element.

7. A method according to claim 6 said calcined aluminium silicate particles have an average particle size of 0.3 to 2 μm.

8. A method according to claim 6 wherein said heat-resistant layer comprises 2 to 500 mg/m2 of aluminium silicate particles.

9. A method according to claim 6 wherein said binder for said heat-resistant layer is a polymeric thermoplast.

10. A method according to claim 9 wherein said polymeric thermoplast is a polycarbonate derived from a bis-(hydroxyphenyl)-cycloalkane corresponding to general formula (I):

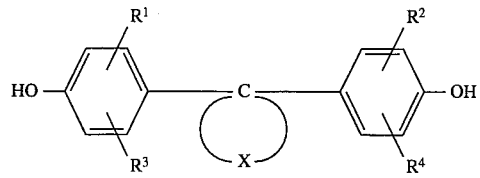

wherein $R^1$, $R^2$, $R^3$, and $R^4$ independently represent hydrogen, halogen, a $C_1$–$C_8$ alkyl group, a substituted $C_1$–$C_8$ alkyl group, a $C_5$–$C_6$cycloalkyl group, a substituted $C_5$–$C_6$ cycloalkyl group, a $C_6$–$C_{10}$ aryl group, a substituted $C_6$–$C_{10}$ aryl group, a $C_7$–$C_{12}$ aralkyl group, or a substituted $C_7$–$C_{12}$ aralkyl group; and X represents the atoms necessary to complete a 5- to 8-membered alicyclic ring, which optionally carries at least one $C_1$–$C_6$ alkyl group or at least one 5- or 6-membered cycloalkyl group, or carries a fused-on 5- or 6-membered cycloalkyl group.

11. A method according claim 6 wherein an average printing power applied by means of a thermal head is more than 4.5 W/mm$^2$.

* * * * *